US008910793B2

(12) United States Patent
Bowers et al.

(10) Patent No.: US 8,910,793 B2
(45) Date of Patent: Dec. 16, 2014

(54) SPLIT CASE SYSTEM FOR DISPLAY CONTAINERS

(75) Inventors: Paul K. Bowers, Long Valley, NJ (US); Julie Conlon, Stamford, CT (US); Bill Smilis, Scarborough (CA); Ronell Scheller, Washington, NJ (US); Katherine Brink, Charlotte, NC (US)

(73) Assignee: Intercontinental Great Brands LLC, East Hanover, NJ (US)

( * ) Notice: Subject to any disclaimer, the term of this patent is extended or adjusted under 35 U.S.C. 154(b) by 241 days.

(21) Appl. No.: 13/503,415

(22) PCT Filed: Oct. 20, 2010

(86) PCT No.: PCT/US2010/053321

§ 371 (c)(1),
(2), (4) Date: Oct. 19, 2012

(87) PCT Pub. No.: WO2011/053493

PCT Pub. Date: May 5, 2011

(65) Prior Publication Data

US 2013/0112592 A1 May 9, 2013

Related U.S. Application Data

(60) Provisional application No. 61/256,335, filed on Oct. 30, 2009.

(51) Int. Cl.

| | |
|---|---|
| ***B65D 85/00*** | (2006.01) |
| ***B65D 77/04*** | (2006.01) |
| ***B65D 5/18*** | (2006.01) |
| ***B31B 1/14*** | (2006.01) |
| ***B65D 5/54*** | (2006.01) |
| ***B65D 5/52*** | (2006.01) |

(52) U.S. Cl.

CPC ..... *B65D 5/52* (2013.01); *B65D 77/042* (2013.01); *B65D 5/18* (2013.01); *B31B 1/14* (2013.01); *B65D 5/548* (2013.01)

USPC ..... 206/774; 206/526

(58) Field of Classification Search

USPC ..... 206/192, 526, 774, 460; 229/235, 238, 229/240

See application file for complete search history.

(56) References Cited

U.S. PATENT DOCUMENTS 3,480,179 A * 11/1969 Rowland ..... 221/63
3,552,082 A * 1/1971 Howard ..... 53/398

(Continued)

FOREIGN PATENT DOCUMENTS

DE 197 10 130 A1 9/1998
EP 0 481 695 A1 4/1992

(Continued)

*Primary Examiner* — David Fidei
(74) *Attorney, Agent, or Firm* — Hoffmann & Baron, LLP

(57) ABSTRACT

This invention pertains to a U-board split case assembly (10) and includes a generally U-shaped case (12) formed from a single blank. A plurality of display containers (14) are attached to and aligned within the U-shaped case. The U-shaped case is folded to include a bottom panel (20) with two opposed parallel side panels (16) extending from opposing edges of a bottom panel, and a shortened lip (22) extend from the front edge of the bottom panel. The plurality of display containers are attached to the side panels to secure the display containers within the U-shaped case. The display containers are removable from the U-shaped case by use of the severing zone (40) on the side panels.

14 Claims, 8 Drawing Sheets

(56) References Cited

U.S. PATENT DOCUMENTS

| | | | | |
|---|---|---|---|---|
| 3,677,458 | A | 7/1972 | Gosling | |
| 3,759,378 | A * | 9/1973 | Werth | 206/192 |
| 3,979,046 | A | 9/1976 | Wilbur | |
| 5,160,023 | A | 11/1992 | Adams et al. | |
| 5,174,444 | A | 12/1992 | Adams et al. | |
| 5,178,268 | A | 1/1993 | Talley et al. | |
| 5,180,056 | A | 1/1993 | Adams et al. | |
| 5,419,431 | A | 5/1995 | Neuber et al. | |
| 5,533,667 | A | 7/1996 | Gale | |
| 5,758,818 | A | 6/1998 | Ewing, Jr. | |
| 5,957,358 | A | 9/1999 | Getz et al. | |
| 6,027,017 | A | 2/2000 | Kuhn et al. | |
| 6,371,365 | B1 | 4/2002 | Doucette et al. | |
| 6,386,369 | B2 | 5/2002 | Yuhas et al. | |
| 6,481,618 | B2 | 11/2002 | Persson | |
| 6,499,655 | B1 | 12/2002 | Moen | |
| 6,729,475 | B2 | 5/2004 | Yuhas et al. | |
| 6,913,189 | B2 | 7/2005 | Oliff et al. | |
| 7,059,494 | B2 | 6/2006 | Harrelson et al. | |
| 7,083,048 | B2 | 8/2006 | Taylor et al. | |
| 2002/0070145 | A1 | 6/2002 | Yuhas et al. | |
| 2004/0222127 | A1 | 11/2004 | McLeod et al. | |

FOREIGN PATENT DOCUMENTS

| | | | |
|---|---|---|---|
| GB | 1 353 314 | | 5/1974 |
| NL | 286532 | | 12/1962 |
| WO | 02/070357 | A1 | 9/2002 |
| WO | 2008/155626 | A2 | 12/2008 |

* cited by examiner

SPLIT CASE SYSTEM FOR DISPLAY CONTAINERS

CROSS REFERENCE TO RELATED APPLICATIONS

This application is the National Stage of International Application No. PCT/US2010/053321, which designates the U.S., filed Oct. 20, 2010, which claims the benefit of U.S. Provisional Patent Application No. 61/256,335 filed on Oct. 30, 2009, the contents of all of which are incorporated herein by reference in their entirety.

FIELD OF THE INVENTION

This invention pertains to a case system that provides for shipment, storage and display of consumable products. More particularly, the present invention relates to a case system removably accommodating a plurality of display containers.

BACKGROUND OF THE INVENTION

It is common for packaged articles to be placed into shipping cases for transport from the place of manufacture to the distributor. Such shipping cases are typically formed from a corrugate fiberboard of sufficient integrity to withstand the rigorous handling during storage and transport. During transportation or handling, the shipping cases are stacked on pallets and at times one pallet stacked onto another. In all of this handling and storage, the shipping case must protect the packaged articles from damage.

One type of shipping case contains a plurality of display containers. Each display container houses a plurality of the packaged articles therein. The packaged articles include individual product packaging filled with product goods. For example, product packaging can be a bag, pouch or box. The product packaging can contain a variety of products such as non-consumable goods or consumable goods, like loose confectionary product. The display containers provide protection of the packaged articles within. In addition, the display containers may also serve to display and dispense the packaged articles at the point of sale.

The display containers are shipped from distributors to retail stores. The distributor fills the orders for the individual stores or point of sale. The order may include an entire shipping case or portions thereof. If the required number of display containers amounts to less than an entire shipping case, then the distributor opens the shipping case and removes the number of display containers ordered and transports the requested number to the store. The store receives that quantity of display containers and places the containers on the shelves. The consumer removes the desired number of packaged articles from each display container.

While protection of the consumable goods is important, there is often much wasted material between the double packaging of shipment cases and display containers. This increases the cost of shipping the consumable goods and contributes to the cost of packaging which is passed on to the purchaser.

It is, therefore, desirable to provide a shipping case and product display container packaging with reduced amount of wasted material required for shipping and storing a product but also provides protection of the package articles and consumable goods within.

SUMMARY OF THE INVENTION

This invention pertains to a split case system for shipping and displaying product. The split case system includes a U-shaped case and a plurality of aligned display containers attached thereto. The U-shaped case has a bottom panel, a pair of opposed longitudinal side panels, and a traverse front panel. The traverse front panel extends upwardly from the bottom panel. The side panels include a detachable portion. The plurality of aligned display containers are supported within the U-shaped case. Each of the display containers are attached to the two opposed side panels of the U-shaped case at the detachable portion. The display containers are releasable from the U-shaped case upon detachment of the detachable portion from the side panel.

Further, this invention pertains to a flat sheet material for forming a U-shaped case including a blank formed in the sheet. The blank has a generally rectangular configuration including a bottom panel, opposed side panels extending from opposed side foldable edges of the bottom panel, and a front panel extending from a front foldable edge of the bottom panel. The front foldable edge is perpendicular to the opposed side foldable edges. Each of the opposed side panels includes a tab extending from a tab foldable edge between the tab and each of the opposed side panel. The opposed side panels include a plurality of breakaway lines extending from a side unattached edge towards the side foldable edge. The breakaway lines divide an upper portion of the opposed side panels into detachable portions. Furthermore, a severing zone can be included extending along each of the opposed side panels for removal of the detachable portions from the U-shaped case.

Additionally, this invention pertains to a method of forming a split case system including the steps of cutting a first blank from a sheet. The first blank includes a blank formed in the sheet, the blank has a generally rectangular configuration including a bottom panel, opposed side panels extending from opposed side foldable edges of the bottom panel, and a front panel extending from a front foldable edge of the bottom panel. The front foldable edge is perpendicular to the opposed side foldable edges, each of the opposed side panels includes a tab extending from a tab foldable edge between the tab and each of the opposed side panel, the opposed side panels include a plurality of breakaway lines extending from a side unattached edge towards the side foldable edge, the breakaway lines divide the opposed side panels into detachable portions, and a severing zone along the side panels to allow for separation of the detachable portions from the side panels. Next, fold the tabs upwardly along the tab foldable edge perpendicularly to the side panels. Further, fold each of the opposed side panels upwardly along each of the side foldable edges perpendicularly to the bottom panel, and fold the front panel upwardly along the front foldable edge perpendicularly to the bottom panel. Attach the tabs to the front edge forming a generally U-shaped case. Place multiple containers within the U-shaped case, each of the containers includes a lid and a base. The base is placed on the bottom panel of the U-shaped case and the lid extends adjacent to the opposed side panels. Finally, attach opposing side panels of each of the lids to opposing detachable portions.

DETAILED DESCRIPTION OF THE PREFERRED EMBODIMENT

The present invention provides a U-board split case assembly or system for shipping, storing, dispensing and displaying a plurality of packaged articles. The assembly includes a U-shaped case and a plurality of aligned display containers attached thereto. The plurality of aligned display containers are supported within the U-shaped case. The U-shaped case includes a pair of side panels with a detachable portion. Each of the display containers are attached to a pair of opposed side panels at the detachable portion. The display containers are releasable from the U-shaped case upon detachment of the detachable portion from the side panel.

Referring to FIGS. 1-8, a U-board split case assembly 10 of the present invention is shown. The U-board split case assembly 10 includes a generally U-shaped case 12 and a plurality of aligned display containers 14 attached to the U-shaped case 12. The U-shaped assembly 10 of the present invention reduces the material required to form the U-shaped case 12 and display containers 14.

Figure 1:
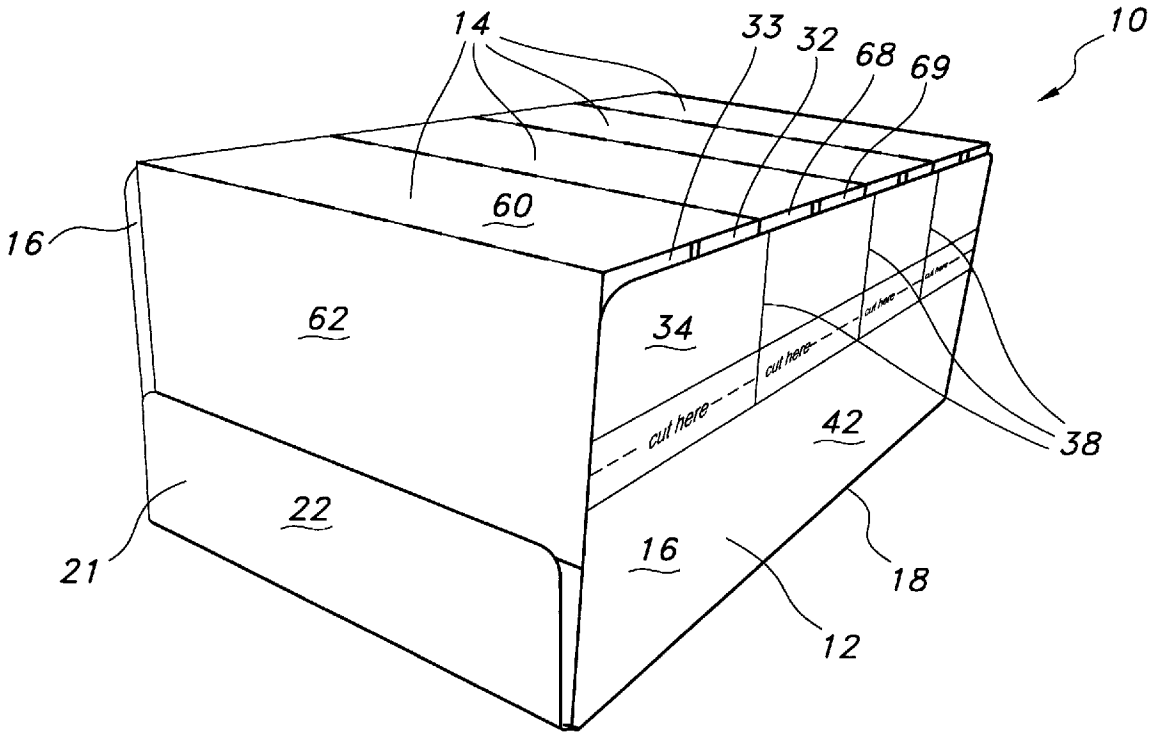
FIG. 1 is a front perspective view of a U-board split case assembly of the present invention.

The U-shaped case 12 includes a detachable portion 54 which allows for the removal of individual display containers 14 upon detachment of the detachable portion 54 from the U-shaped case 12. FIG. 1 shows the front end 21 of the U-shaped case 12 includes a front panel 22 or lip which extends from the bottom panel 20 and between the two opposed side panels 16. The front panel 22 is shorter in height than the side panels 16. The front panel 22 serves as a stop for the display containers 14 once they are detached from the remaining U-shaped case 12.

Figure 2:
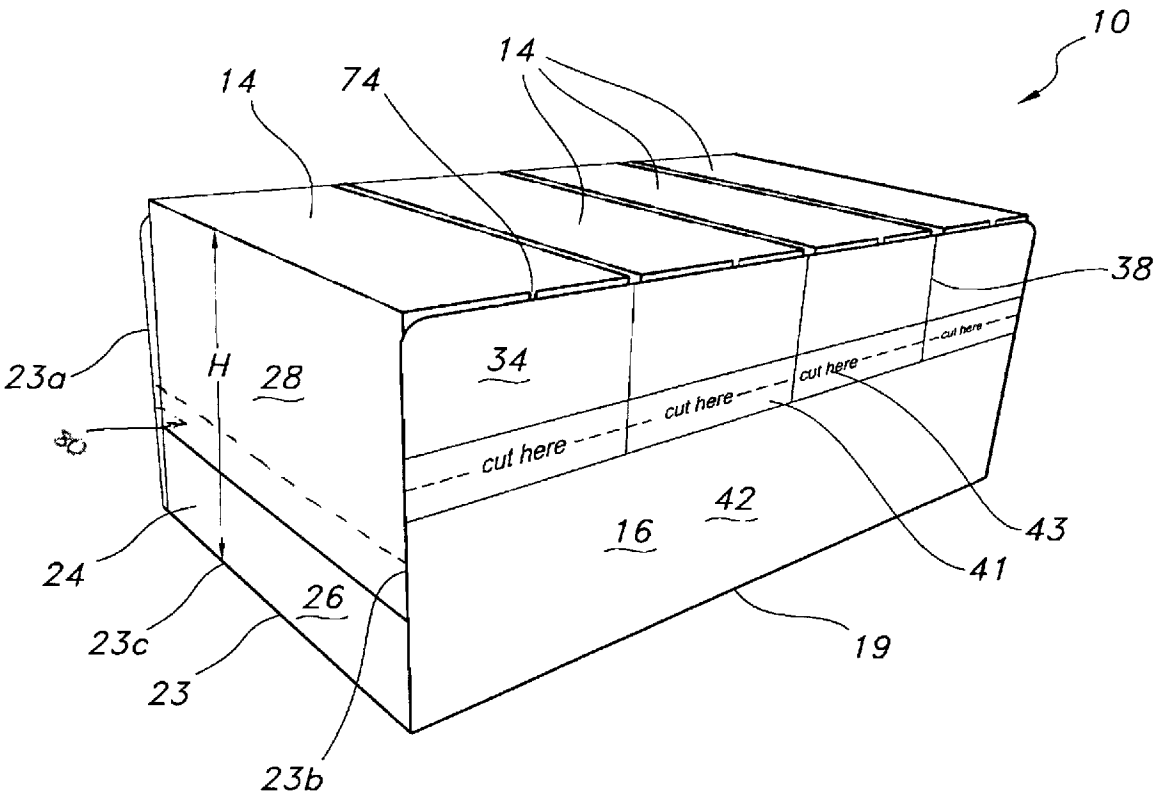
FIG. 2 is a rear perspective view of the U-board split case assembly of FIG. 1.

FIG. 2 shows the back end 24 of the U-shaped case 12. The back end 24 of the U-shaped case 12 is an open end defined by a continuous unattached side edge 23 which has two unattached back side edges 23*a*, 23*b* of the two side panels 16 and a center unattached edge 23*c* of the bottom panel 20 extending between the two side panels 16. Preferably, the back end 24 does not include a lip or panel extending from the bottom panel 20. However, it is within the scope of the present invention that a rear panel 80 may extend upwardly from the bottom panel 20 and between the side panels 16. The rear panel 80 is similar to the front panel 22 in structure and attachment to the side panels 16 using tabs 50.

Figure 3:
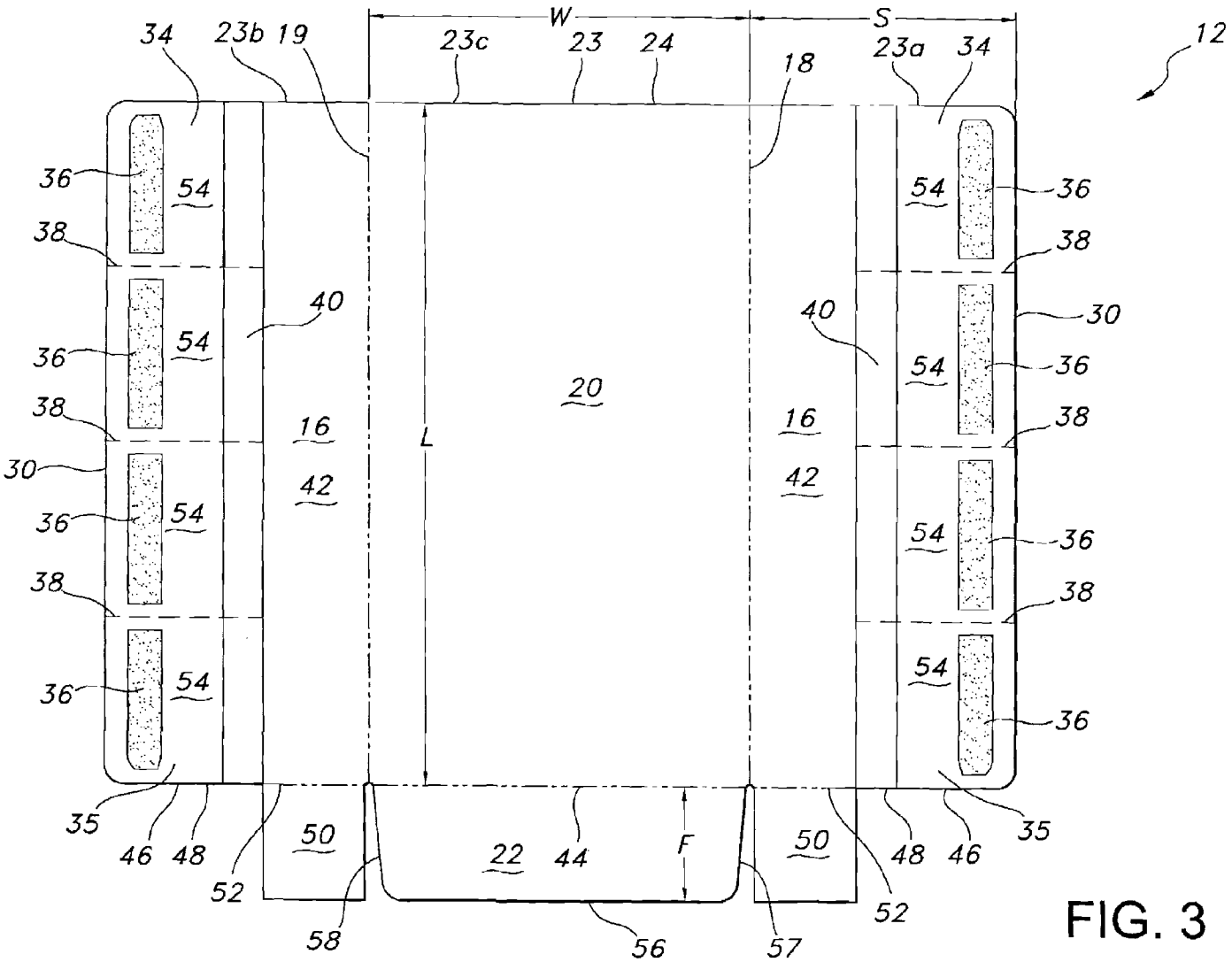
FIG. 3 is a top plan view of the die cut blank used to form the U-shaped container of FIG. 1.

Referring to FIG. 3, a flat sheet die cut blank used to form the U-shaped case 12 of the present invention is shown. FIG. 3 shows the U-shaped case 12 cut from a single piece of material. The bottom panel 20 is rectangular with the opposed side panels 16 extending from two opposing side foldable edges 18, 19 of the bottom panel 20 along the length (L) of the bottom panel 20. The front panel 22 extends from a front foldable edge 44 of bottom panel 20 along the width (W) which is perpendicular to the side panels 16. The edge opposite from the front foldable edge 44 is the back cut edge 23 which remains unattached.

The length of the front panel 22 is the width (W) of the bottom panel 20 and extends from the front foldable edge 44 to the front unattached edge 56. The front panel 22 is shown tapering toward the front unattached top edge 56. While it may be desirable to have the front panel tapering, it is not a required feature. The front panel 22 has a front foldable edge 44, and three unattached cut edges (56,57,58). The width or height (F) of the front panel 22 is less than the width or height (S) of the side panel 16.

The pair of opposed side panels 16 are mirror images of each other. Each side panel 16 is generally rectangular with opposing side foldable edges 18,19 attached to the bottom panel 20 by material continuity. The length of the side panels 16 is similar to the length (L) of the bottom panel 20. The width (S) of the side panel 16 is shorter than the width (W) of the bottom panel 20. The top edge 30 is the opposite edge of the side panel 16 from the opposing side foldable edges 18, 19. The top edge 30 is also unattached along the length of the side panel 16. The back edge 23 includes back side edges 23*a*, 23*b* and back center edge 23*c*. The side panel front edge 46 includes an unattached edge 48 and an attached edge 52. The attached edge 52 is attached to a tab 50 which is an outward projection from attached edge 52. FIG. 3 shows tabs 50 as square planar panels. The tab 50 is used to attach the side panel 16 to the front panel 22 by use of an adhesive or other mechanical attachment mechanism, as shown in FIG. 1. The tabs 50 extend from the side panel 16, parallel and spaced apart from the front panel 22.

Figure 4:
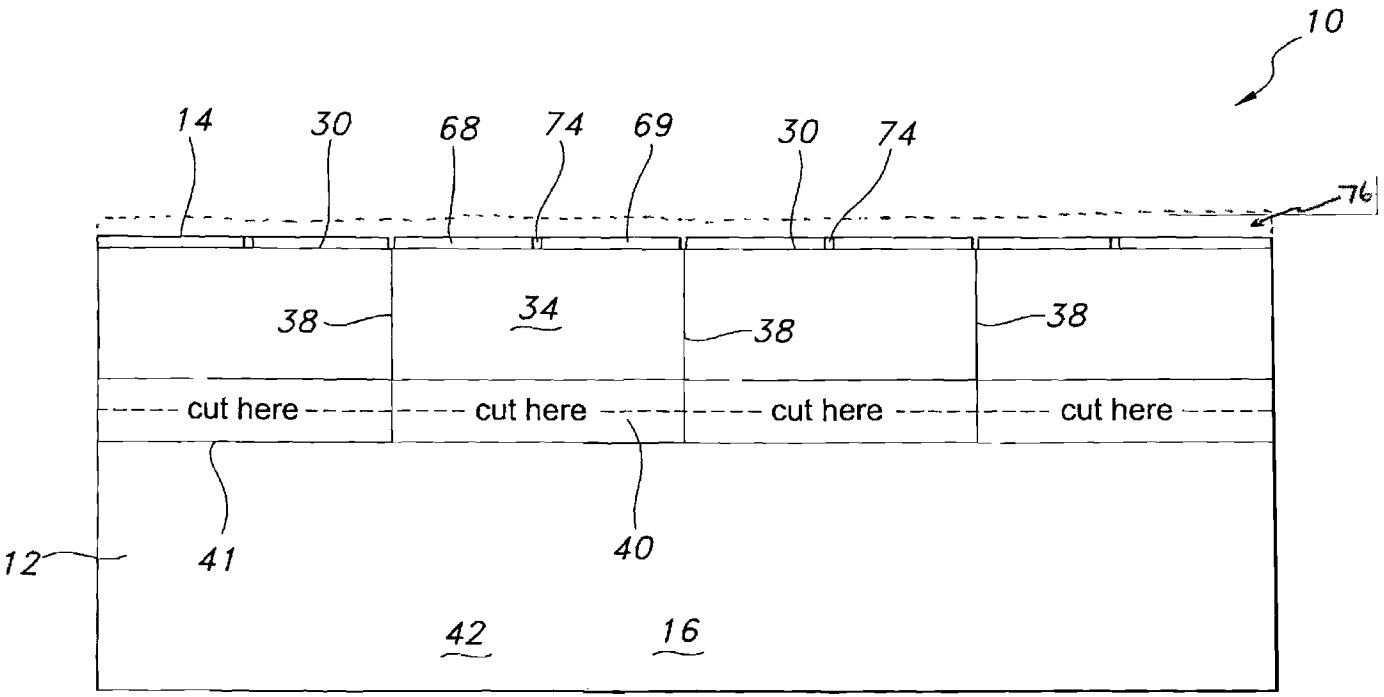
FIG. 4 is a side plan view of the U-board split case assembly of FIG. 1.
Figure 5:
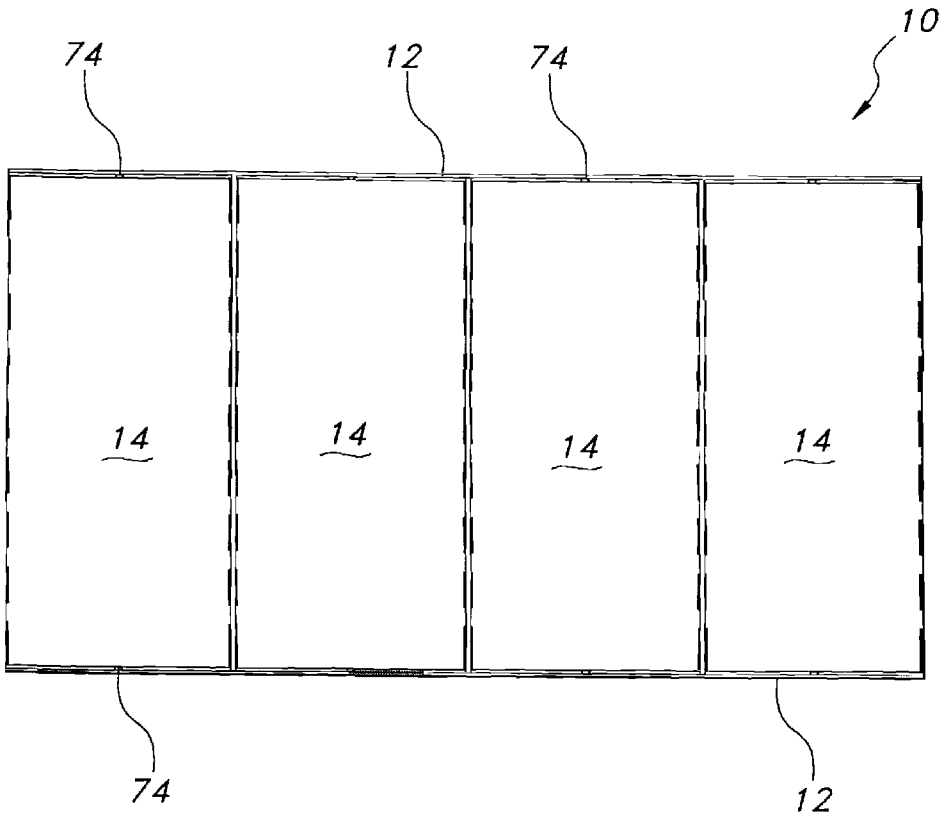
FIG. 5 is a top plan view of the U-board split case assembly of FIG. 1.

Additionally, referring to FIG. 4, the pair of side panels 16 include an upper extent 34, a lower extent 42 and a severing zone 40 therebetween. The upper extent 34, lower extent 42 and the severing zone 40 extend along the side panel 16. The upper extent 34 may be one detachable portion 54 or, preferably, the upper extent 34 can be divided into multiple detachable portion 54 by breakaway lines 38. Each breakaway line 38 extends from the top unattached edge 30 of the side panel 16 through the severing zone 40 to the base 41 of a severing zone 40, as shown in FIG. 4. The breakaway lines 38 are spaced between the aligned display containers 14 to permit individual removal of the display containers 14 from said U-shaped case, as shown in FIGS. 1, 2, 7 and 8. The breakaway lines 38 allow for the display containers 14 to be removed individually from the remaining display containers 14 in the U-shaped case 12. The breakaway line 38 may include any mechanism used to separate the side panel 16 such as a slit, perforations, weakened area, punch outs and the like. Each detachable portion 54 has an adhesive 36 on the inner surface that is used to attach each of the detachable portions 54 of the side panel 16 to the display containers 14. Thus, the upper extent 34 is attached to the display container 14, while the lower extent 42 is not attached to the display containers 14.

The side panel 16 includes a severing zone 40. The severing zone 40 may include a mechanism for separating the detachable portion 54 from the lower extent 42. The severing zone 40 may include a weakened section, a perforated section, pull tab, or other mechanical separator mechanisms. Preferably, the severing zone 40 is an area that may include guide location 43 to guide the user in manually cutting within a specific area across the length of the side panel 16 to disconnect the display containers 14 from the U-shaped case 12 without damaging the display containers 14 or contents inside. The detachable portion 54 thus becomes severed and disconnected from the lower extent 42. In addition, the individual display containers 14 become released or severed from the U-shaped case 12 upon detachment of the detachable portion 54 from one another, and the display containers 14 can then be individually removed from within the U-shaped case 12. Only the detachable portion 54 of the side panels 16 remains attached to the display container 14 after the detachable portion 54 is releasably detached from the U-shaped case 12.

The U-shaped case 12 is assembled by folding the side panels 16 toward the interior surface of the bottom panel 20. The side panels 16 are folded at opposing side foldable edges 18,19 raising the side panels 16 perpendicular to the bottom panel 20 and parallel to each other. The tab 50 is folded inwardly at attached edges 52 such that the tab 50 is perpendicular to side panels 16 and perpendicular to the bottom panel 20. The front panel 22 is folded along front foldable edge 44 such that the front panel 22 is perpendicular to bottom panel 20 and side panels 16. The tab 50 may include an adhesive on the exterior surface. The front panel 22 is attached to the tab 50 using the adhesive. The interior surface 35 of front panel 22 is coextensive with the exterior surface of tab 50 and the surfaces are adhered together, as shown in FIG. 1. The assembled U-shaped case 12 provides in interior cavity to receive the display containers 14 therein.

The U-shaped case 12 is configured to accommodate a plurality of individual display containers 14, as shown in FIG. 3. The display containers 14 maybe rectangular in shape and include a base 26 and lid 28. FIG. 2 shows the back end 24 of the U-shaped case 12 which exposes the entire side of the display container 14 including the base 26 and lid 28. The display containers 14 extend slightly above the top edges 30 of the side panels 16 to prevent an exposed top edge 30 of the side panel 16 from interfering with conveying devices or stacking of the cases. The height (S) of the side panel 16 is less than the height (H) of the display containers 14. However, it is within the scope of the present invention that the upper portion 32 is extended such that the height of the extended upper portion 76 is greater than the height of the display lids to protect the display containers from damage during shipment and storage of the assembly 10, as shown in FIG. 4. The upper portion 32 of the lids 28 of each display container and the detachable portion 54 of the side panels 16 are attached. The exterior surface 33 of the display containers 14 and the inner surface 35 of the detachable portion 54 of the pair of opposed side panels 16 are secured together by use of adhesive 36, tacking, or other mechanical attachment mechanisms.

Figure 6:
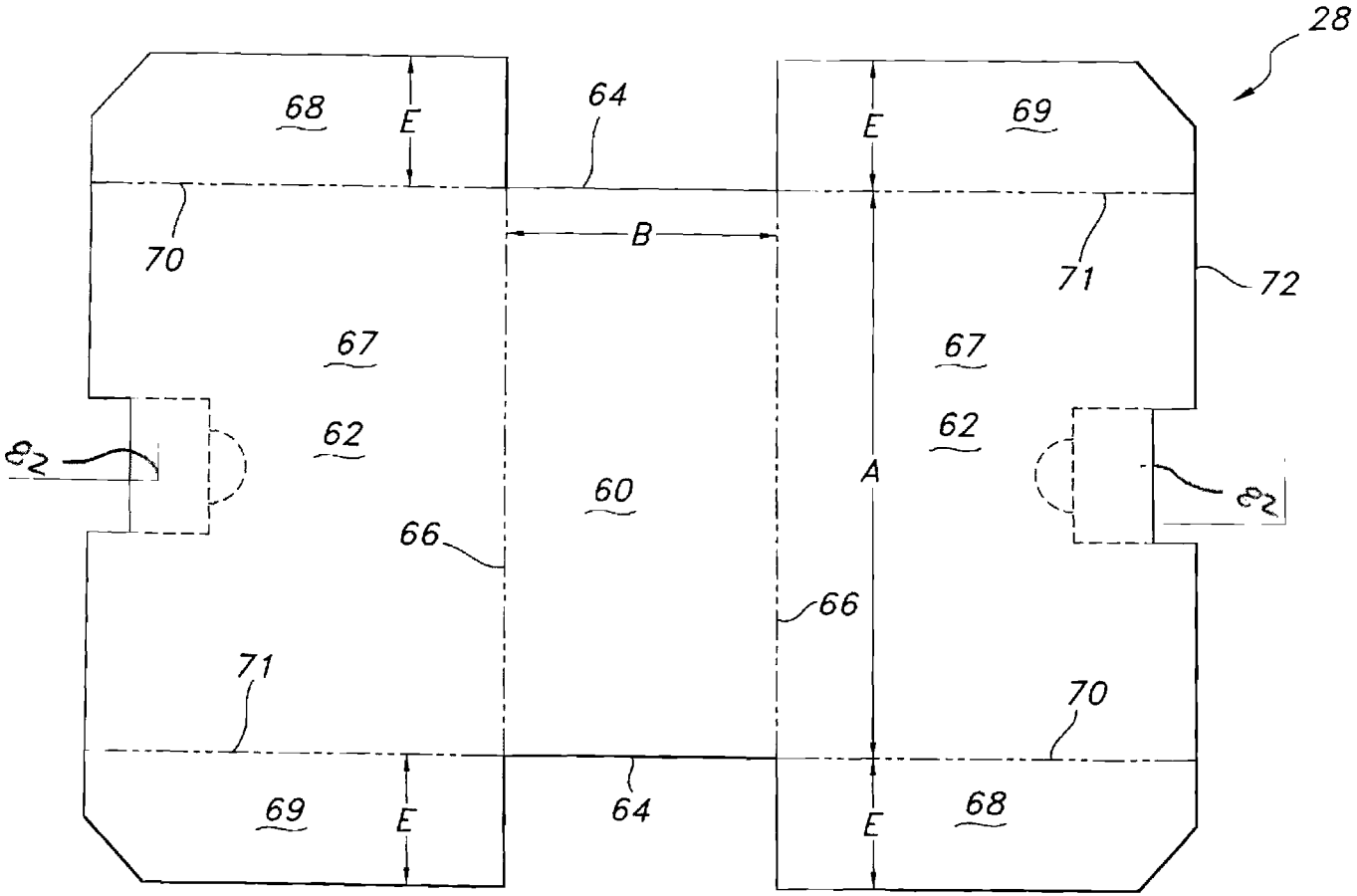
FIG. 6 is a top plan view of the die cut blank used to form the lid of the display container of FIG. 1.

FIG. 6 shows a flat sheet die cut blank used to form the lid 28 to the display container 14. The lid 28 includes a top lid panel 60 and two depending side wing panels 62. The top lid panel 60 is rectangular including two shorter edges 64 that are cut and unattached; and two opposing edges 66 along the length of the top lid panel 60. Each side wing 62 is identical to the other. Each side wing 62 is a large rectangular panel which is connected to the bottom panel 60 along the folded edge 66. The side wing 62 extends beyond the length (A) of the top lid panel 60 on either side of the top lid panel 60 defining extension wings 68, 69. The width (E) of each extension wing 68, 69 is equal to or less than half the width (B) of the top lid panel 60. Thus, when the display lid 28 is assembled, the opposing extension wings 68, 69 do not overlap. This helps reduce the required material to form the display lid 28. Each side wing 62 includes a removable portion 82 which has an adhesive thereon for attachment of the lid 28 to the base 26.

The display lid 28 is assembled by folding the side wings 62 along the opposing folded edge 66. The side wings 62 are perpendicular to the top lid panel 60 and parallel to each other when folded and assembled. The extension wings 68,69 are folded along the extension wing folded edges 70, 71. Each extension wing 68, 69 is perpendicular to the center portion 67 of the side wing 62 and perpendicular to the top lid panel 60 when folded and assembled. Generally, the assembled shape is a rectangular box with one open end opposite the top lid panel 60. The open end is defined by the unattached side wing edges 72 which forms a rectangular opening when folded and assembled.

The open end of the display lid 28 is placed inside of a display base 26 and attached thereto by use of an adhesive, such as glue, as shown in FIG. 2. The display base 26 is a rectangular tray-like structure of conventional construction. Further, FIG. 1 shows the display lid 28 having spaced apart extension wings 68,69 defining space 74 when folded and assembled. The extension wings 68, 69 are secured in place and attached together by the adhesion of two opposed extension wings 68, 69 to the detachable portion 54. The detachable portion 54 extends across the exterior surface of the extension wings 68, 69 and secures the extension wings 68, 69 together.

The display containers 14 house a plurality of packaged articles therein. The packaged articles may include individual product packaging such as bags, boxes or pouches. The packaged articles are filled with products which may include non-consumable goods or consumable goods. The consumable goods may include loose confectionary products. The lid 28 is removed and the base 26 functions as a display tray to hold the packaged articles together in a store shelf.

Figure 7:
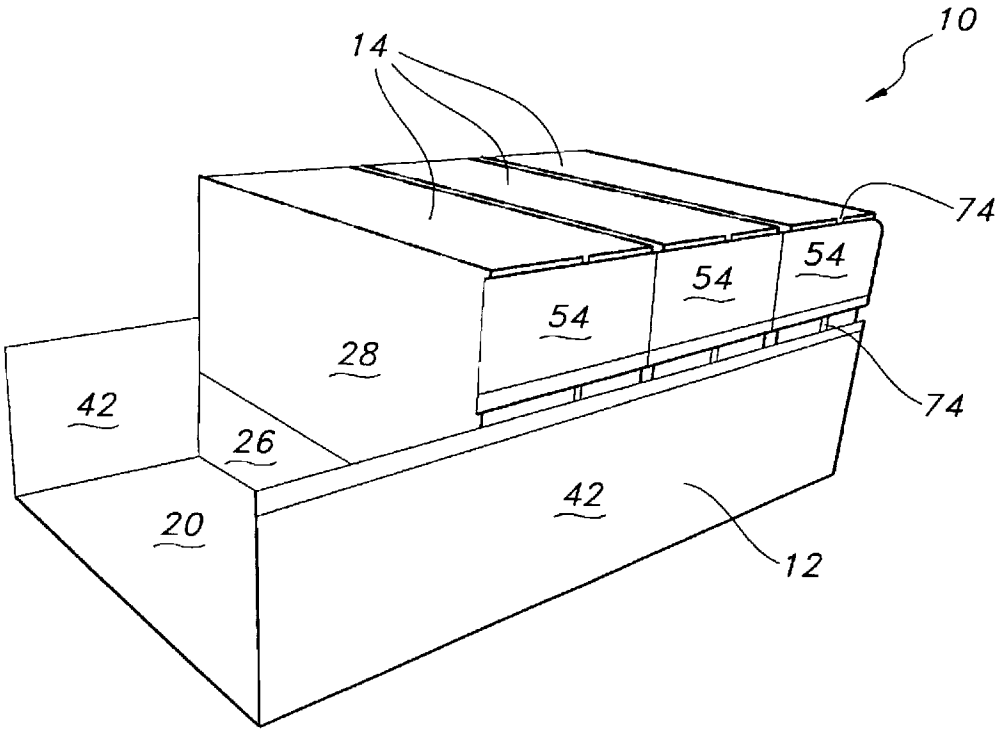
FIG. 7 is a rear perspective view of the U-board split case assembly of FIG. 1 with a display containers detached from the U-shaped case and one display container removed therefrom.
Figure 8:
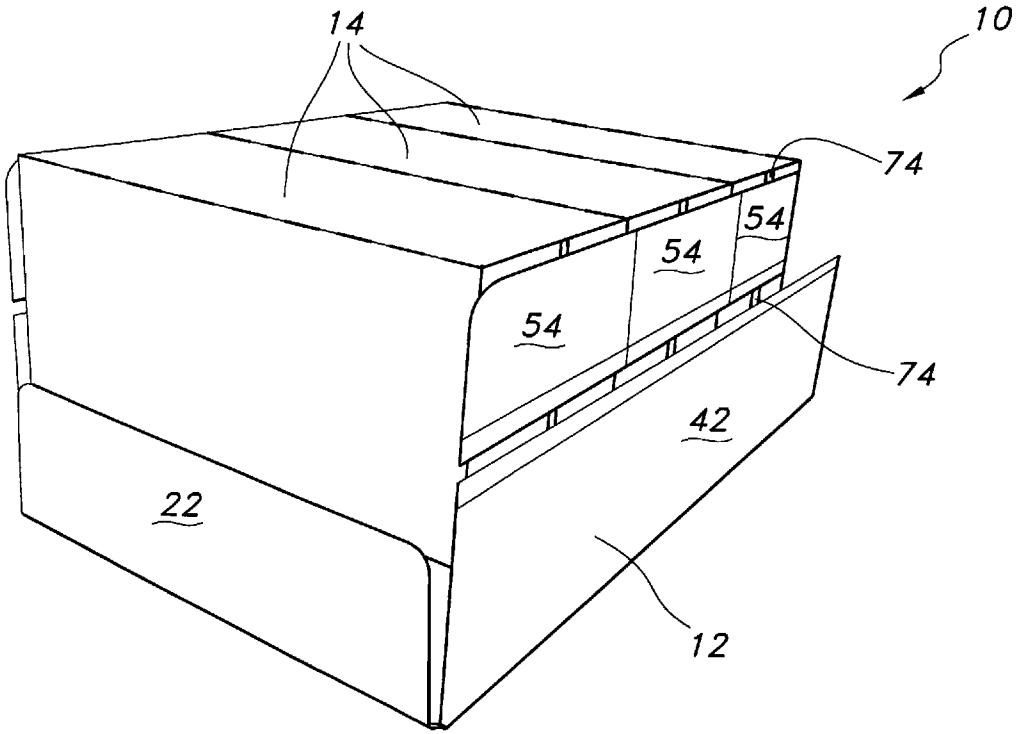
FIG. 8 is a front perspective view of the U-board split case assembly of FIG. 1 with a display containers detached from the U-shaped case and one display container removed therefrom.

Referring to FIG. 7-8, once the U-board split case assembly 10 is shipped to a destination, such as a distributor, and where less than a full case is desired to be further transported, then the severing zone 40 is utilized and the detachable portions 54 become detached from the remaining U-shaped case 12. The detachable portion 54 remains attached to the extension wings 68, 69. The severance of the detachable portion 54 from the U-shaped case 12 allows the display containers 14 to be released from the U-shaped case 12. The individual display containers 14 are removable from the U-shaped case 12, as shown in FIGS. 7 and 8.

One use of the U-board split case assembly 10 is with an angled slide tray conveying device. Once the detachable portion 54 is released from the side panels 16, display containers 14 are also released from the side panels 16 and loosely contained within the U-board case 12. The U-board split case assembly 10 can be placed on the angled slide tray conveying device, such that the assembly 10 is angled toward the front end 24, the front end 24 is lower than the back end 24. The remaining display containers move forwards towards the front panel 22 as a display container 14 is removed from within the U-shaped case 12. FIG. 7 shows the display containers 14 remain aligned and upright because the U-shaped case 12 and lower extent 42 provide support and guidance for the display containers 14 within the U-shaped case 12. Additionally, FIG. 8 shows that the front panel 22 acts as a stop and prevents the display containers 14 from sliding out from the U-shaped case 12.

Having described the preferred embodiments herein, it should now be appreciated that variations may be made thereto without departing from the contemplated scope of the invention. Accordingly, the preferred embodiments described herein are deemed illustrative rather than limiting, the true scope of the invention being set forth in the claims appended hereto.

What is claimed is:

1. A split case system for shipping and displaying product comprising:

a generally U-shaped case having a bottom panel and a pair of opposed longitudinal side panels each said side panel including an upper extent and a lower extent and a severing zone therebetween; and a plurality of aligned display containers supported within said U-shaped case, each of said display containers being attached to said two opposed side panels of said U-shaped case at said upper extents, and being releasable from said U-shaped case upon severing said upper extent from said lower extent at said severing zone.

2. The split case system of claim 1 wherein said display containers are adhesively attached to said upper extent of said side panels.

3. The split case system of claim 1 wherein said upper extent includes a plurality of spaced apart breakaway lines extending from an upper edge of said upper portion to said severing zone, said breakaway lines being spaced between said aligned display containers permits individual removal of said display containers from said U-shaped case.

4. The split case system of claim 3 wherein said breakaway lines include perforation lines.

5. The split case system of claim 3 wherein said breakaway lines include slits.

6. The split case system of claim 1 wherein said severing zone includes a guide location for guiding manual cutting thereat.

7. The split case system of claim 1 wherein said severing zone includes a detachable strip.

8. The split case system of claim 1 wherein said U-shaped case is formed from a unitary die cut blank.

9. The split case system of claim 1 further including a traverse front panel extending upwardly from said bottom panel.

10. The split case system of claim 9 said front panel is shorter in height than the side panels.

11. The split case system of claim 9 further including a tab extending from an edge of said lower extent, said tab is attached to said front panel to secure each side panel to said front panel.

12. The split case system of claim 9 further including a traverse rear panel extending upwardly from said bottom panel.

13. The split case system of claim 1 wherein said display container includes a lid and a base, said lid is attached to said detachable portion.

14. The split case system of claim 1 wherein said display container has a height shorter than the height than said side panels.

* * * * *